US011670899B2

(12) United States Patent
Berg et al.

(10) Patent No.: US 11,670,899 B2
(45) Date of Patent: Jun. 6, 2023

(54) CURRENT BAR MODULE AND CORRESPONDING CONNECTION MODULE

(71) Applicant: Phoenix Contact GmbH & Co. KG, Blomberg (DE)

(72) Inventors: Peter Berg, Schlangen (DE); Andreas Metzger, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 427 days.

(21) Appl. No.: 17/033,323

(22) Filed: Sep. 25, 2020

(65) Prior Publication Data

US 2021/0098955 A1 Apr. 1, 2021

(30) Foreign Application Priority Data

Sep. 27, 2019 (DE) ..... 102019126155.4

(51) Int. Cl.
*H01R 25/16* (2006.01)
*H01R 9/26* (2006.01)

(52) U.S. Cl.
CPC ..... *H01R 25/162* (2013.01); *H01R 9/265* (2013.01); *H01R 9/2608* (2013.01); *H01R 9/2658* (2013.01)

(58) Field of Classification Search
CPC .... H01R 25/162; H01R 9/2608; H01R 9/265; H01R 9/2658; H01R 9/2616; H01R 25/142; H01R 25/145; H01R 9/2675
See application file for complete search history.

(56) References Cited

U.S. PATENT DOCUMENTS 7,586,052 B2 * 9/2009 Adunka ..... H01H 11/0031 200/293
2017/0214199 A1 * 7/2017 Masel ..... H01R 25/162

FOREIGN PATENT DOCUMENTS

DE 10351479 A1 5/2004
DE 102006031129 A1 1/2007
DE 202017104591 U1 11/2018
DE 102018005682 A1 2/2019

* cited by examiner

*Primary Examiner* — Jean F Duverne
(74) *Attorney, Agent, or Firm* — Weber Rosselli & Cannon LLP

(57) ABSTRACT

A conductor rail module for distributing and a corresponding connection module for tapping a direct current distributed along a mounting rail is described. The connection module comprises a housing whose electrically insulating rear section is connected or connectable to the mounting rail in a form-fit manner. A front section of the housing has a plurality of electrically insulating transverse struts extending transversely to a longitudinal direction of the conductor rail module. Furthermore, the conductor rail module comprises at least two conductor rails extending in the longitudinal direction in the housing between the rear section and the front section, which conductor rails are configured to contact the connection modules for distributing the direct current through a gap between the transverse struts when the connection modules are in a position mounted on the conductor rail module.

20 Claims, 7 Drawing Sheets

CURRENT BAR MODULE AND CORRESPONDING CONNECTION MODULE

FIELD

This disclosure relates to, without being limited to, conductor rail modules for distributing a direct current to connection modules and corresponding connection modules.

BACKGROUND

To reduce the wiring effort for distributing an operating current to electrotechnical modules on a mounting rail, conductor rails can be used. The ABB "Smissline TP" system includes finger-safe conductor rails for three-phase alternating current. However, the system is not compatible with existing mounting rails, especially top-hat rails.

Furthermore, conventional conductor rails have an unchangeable length. To add another conductor rail, installation space on the mounting rail must be used for a terminal module that wires the conductor rails on both sides of the terminal module. As a result, the installation space is either not optimally used or a new installation is required, i.e., replacing the existing conductor rail with a longer one.

The document EP 2 086 101 A2 describes connection slides to electrically connect adjacent connection modules on a mounting rail with regard to a potential. However, such connection slides increase the overall height of the connection modules, can only pass on a single potential and the number of contact points increases with the length of the distribution system, making it unsuitable for high currents, for example for distributing a direct current in the order of 40 A.

SUMMARY

This disclosure has the task to remedy this situation. In particular, this disclosure may be based on the task of providing a technique for distributing or branching a direct current along a mounting rail without creating a gap or empty space due to an extension of the distribution system.

A first aspect of this disclosure relates to a conductor rail module for distributing a direct current to connection modules arranged or arrangeable along a mounting rail. The conductor rail module comprises a housing. An electrically insulating rear section of the housing is positively (i.e., in a form-fit manner) connected or connectable to the mounting rail. A front section of the housing has a number of electrically insulating transverse struts extending transversely to a longitudinal direction of the conductor rail module. The conductor rail module further comprises at least two conductor rails extending in the longitudinal direction in the housing between the rear section and the front section. The conductor rails are configured to contact the connection modules for distributing the direct current through a gap between the transverse struts when the connection modules are in a position mounted on the conductor rail module.

In embodiments of the conductor rail module, by placing the conductor rails between the rear section and the front section, the transverse struts can prevent unintentional contact or short circuiting of the conductor rails. In the same or further embodiments of the conductor rail module, since the transverse struts extend transversely to the longitudinal direction, the conductor rails can be contacted by a rail contact that is resilient in the transverse direction (i.e., along the gap). This means that the connection modules can be narrow in the longitudinal direction or more connection modules can be mounted on a given length of the mounting rail.

Embodiments of the conductor rail module can enable the distributing (for example the conduction and/or branching) of the direct current parallel to the mounting rail. The installation space can be used optimally, for example without increasing the height of the connection modules, by arranging the conductor rails in a U-shaped recess of the mounting rail by means of the conductor rail module.

The conductor rail modules can reduce the wiring effort for distributing the direct current to the connection modules (for example from the connection modules, for the connection modules or via the connection modules) on the mounting rail. The direct current may be an operating current for the operation of the respective connection module, or a load fed by the connection module.

An upper edge of the conductor rail may be inside the housing. The upper edge of the conductor rail may be lower (i.e., further to the rear section or mounting rail) than the transverse struts. This can prevent an accidental short circuit, e.g., without insulating the top edge, which may simplify fabrication and/or prevent the rail contacts from having to overlap insulation at the top edge.

A nominal voltage of the direct current may be 12 V to 24 V or 24 V to 48 V.

The housing of the conductor rail module, e.g., the rear section, may have steps on a first long side for mounting the connection modules. Alternatively, or in addition, the housing, e.g., the rear section, may have snap-in profiles on a second long side for mounting the connection modules.

Each of the steps may be configured to cooperate (or interact or engage) with a latch of the respective connection module in a mounted position of one of the connection modules for a positive connection. In a mounted position, the latch may abut the step and in an unlocked position it may release the step. Alternatively, or in addition, each of the snap-in profiles may be configured to positively engage with a complementary snap-in profile of the respective connection module in the mounted position of one of the connection modules.

In the housing of the conductor rail module, an electrically insulating partition wall may be arranged between two adjacent conductor rails of the at least two connection modules (for example, each).

The mounting rail may comprise snap-in edges projecting transversely to the longitudinal direction. The mounting rail may be a U-shaped top-hat rail, for example according to the standard DIN EN 50 022. The top-hat rail may have side legs with snap-in edges folded outwards.

The rear section may have at least two opposite detents facing each other. The detents may be configured to slide from an unmounted position of the conductor rail module over the snap-in edges of the mounting rail into a snap-in position of the conductor rail module, in which the detents connect the rear section of the conductor rail module to the mounting rail with a positive fit (i.e., in a form-fit manner).

The conductor rails in the conductor rail module may include a conductor rail for functional earthing, a conductor rail to a neutral conductor and a conductor rail to a positive pole. The conductor rails may form a power bus.

Each of the at least two conductor rails may have a transverse dimension, QM, transverse to the longitudinal direction and height dimension, HM, in the direction between the front section and the rear section. The height dimension HM may be greater than the transverse dimension QM. The height dimension may be several times larger than the transverse dimension. The conductor rails may be parallel to each other in the housing.

In addition, at least one end face of the conductor rail module may be configured to electrically connect the conductor rails of the conductor rail module with corresponding conductor rails of a conductor rail module adjacent to the respective end face.

The end face connection (or front side connection) may allow modularity and/or expandability of the conductor rail module or a system with at least two conductor rail modules that are electrically connected (e.g., by plugging them together) at the respective front side.

In addition, the conductor rail module may include a punched contact plugged or pluggable onto an associated conductor rail in the longitudinal direction on at least one end face of the conductor rail module. The punched contacts may be configured to electrically connect the conductor rails of the conductor rail module with corresponding conductor rails of a conductor rail module adjacent to the respective front side.

The punched contacts may allow modular expansion of the conductor rail module along the mounting rail. The punched contacts may be mirror-symmetrical in the longitudinal direction with respect to the front side.

According to another aspect of this disclosure, a set of at least two conductor rail modules and a large number of punched contacts (for example, as loose parts) may be provided.

At least one or each of the punched contacts may have an open clamping slot at opposite ends in the longitudinal direction. An open width and/or force-free width of the clamping slot may be equal to or smaller than the transverse dimension QM of the respective conductor rail. At each end of the open clamping slot, projections facing each other may narrow the width of the open clamping slot at the respective end.

At least one or each of the punched contacts may comprise two, three or more stratification sheets of the same shape, one on top of the other.

In embodiments, the punched contacts may each electrically connect the individual conductor rails of directly adjacent (for example, face-to-face) conductor rail modules, e.g., without loss of slot space. Alternatively, or in addition, the punched contacts may allow the construction of a distribution system (also: distribution rail system) with a multitude of conductor rail modules. The distribution system may thus be modularly expandable, for example by separate electrical connection of the associated conductor rails. For example, the punched contacts may include a space-optimized conductor rail connector for a distribution system with 24 V direct current.

At least one or each of the punched contacts may be configured to support an electrical connection of the associated conductor rails for 40 A continuous current.

The punched contact may extend in the longitudinal direction or in alignment (i.e., in a straight line) of the two electrically connected conductor rails. The punched contact may be perpendicular to the high dimension (or height dimension) of the corresponding conductor rail.

Alternatively or in addition, the punched contact may overlap in the longitudinal direction with at least one of the transverse struts of the conductor rail module and/or with at least one of the snap-in profiles of the conductor rail module and/or at least one section of one of the conductor rails of the conductor rail module contacted or contactable by a rail contact of the connection module.

The punched contacts may be arranged to enable the modularity of a system with at least one conductor rail module and at least one connection module mounted on the conductor rail module and/or the mountability of at least one connection module on the conductor rail module without loss of mounting places (e.g., slots). For example, at least two connection modules (e.g., circuit breakers) may be mounted adjacent to each other (for example pluggable), e.g., above the punched contact in the direction towards the front section and/or away from the rear section.

On at least one front side (with respect to the longitudinal direction) of the conductor rail module, the conductor rail module may further comprise a continuous recess both in the respective front side and a support surface of the front section facing away from the rear section. The continuous recess may be configured to shift the conductor rail module against an adjacent conductor rail module along the mounting rail by means of a lever which is received or can be received in the continuous recess.

The continuous recess may be configured to allow a gap to be levered between adjacent conductor rail modules along the mounting rail, e.g., using a screwdriver as the lever. This may allow a user-friendly removal of the conductor rail module.

A second aspect of this disclosure relates to a connection module for branching a direct current distributed along a mounting rail. The connection module comprises a housing. A rear of the housing is mounted or mountable on a conductor rail module according to the first aspect. A front of the housing has at least two terminal contacts for connecting a load or a source of direct current. The connection module also has at least two rail contacts protruding from the rear for branching (e.g., branching off or tapping) the direct current. The rail contacts are configured to contact one conductor rail of the conductor rail module at a time when the connection module is in a position mounted on the conductor rail module.

To protect against overload and/or short-circuit, e.g., of electrical 24V DC loads, the connection module may include a (for example electronic) device circuit breaker. The device circuit breaker may be configured to limit a load current (i.e., the current branched off at the conductor rails and/or the current output at the terminal contacts) to a certain value.

The terminal contacts of a connection module may include one output channel (e.g., with two or three terminal contacts) or multiple output channels. The load current may be fused separately for each output channel. For example, a connection module or output channel may be assigned a current of up to 40 A.

Embodiments may allow a connection module mounted mediately (i.e., indirectly) on the mounting rail via the conductor rail module to tap the direct current distributed along the mounting rail. The conductor rail module according to the first aspect may be configured to be mounted on the mounting rail. The connection module according to the second aspect may be configured for mounting on the rail module.

The connection module may be indirectly connected or connectable to the mounting rail (e.g., only indirectly and/or only by means of the conductor rail module). The connection module may only be connected or connectable to the conductor rail module, which in turn is connected or connectable to the mounting rail.

Embodiments may be installed or installable on a universal or existing mounting rail, for example on a mounting rail which is not limited to a direct current system or a system for distributing direct current. An existing mounting rail for distributing direct current may be further developed by means of the conductor rail modules specific for direct current and/or designed for direct current. Alternatively or in addition, the indirect mounting of the connection modules on the mounting rail or the form-fit connection of the connection modules on the conductor rail module may ensure that the connection module and the conductor rail module are designed for the same or a coordinated current (for example, the same or coordinated current type, current intensity and/or voltage).

At least one or each of the rail contacts may include a double-sided contact, for example a double-sided spring contact (e.g., tulip contact). The spring contact may be configured to provide resilient contact to the respective conductor rail on both sides. At least one or each of the rail contacts may be configured to contact the conductor rail resiliently from both sides in a gap between the transverse struts. The rail contact may be a double-sided double contact or a double-sided multiple contact with two or more contacts on each side of the conductor rail.

The rear of the connection module may include a recess to accommodate the conductor rail module in the mounted position.

The connection module may include an overcurrent protection device between the rail contacts and the terminal contacts to protect the load or source of direct current. The overcurrent protection device (also: fuse, e.g., device fuse) may be an electronic fuse.

The connection module may be connected to a data bus along the mounting rail, for example via data bus contacts on the housings of the connection modules which touch each other in the mounted position. The connection module may output a state of the electronic fuse via the data bus. Alternatively, or in addition, the connection module may receive an instruction to reset (i.e., to reset or close) the electronic fuse via the data bus.

The rear of the connection module may be mounted or attachable to a first and a second conductor rail module adjacent to each other in the longitudinal direction at their respective front ends. At least a first rail contact of the rail contacts of the connection module may be contacted by one of the conductor rails of the first conductor rail module. At least a second rail contact of the rail contacts of the same connection module may contact a second conductor rail module of adjacent conductor rail modules when the connection module is in the mounted position. In other words, the connection module may be mounted or mountable over a frontal connection point of two adjacent conductor rail modules (e.g., without loss of slot space at the connection point).

The connection module may also include a latch that may be moved on a first long side transversely to the longitudinal direction for positive (e.g., form-fit) connection of the connection module to the conductor rail module in the mounted position. In the mounted position, the latch may protrude from the housing, e.g., at or near the rear, transversely to the longitudinal direction. Alternatively, or in addition, the connection module may also include a snap-in profile on a second long side of the rear for positive connection of the connection module to the conductor rail module in the mounted position.

The connection module may also include a swivel lever mounted in the housing. The swivel lever may be swiveled into an unlocked position by means of an operating surface protruding from the housing in the mounted position. The swivel lever may be swiveled from the unlocked position to the mounted position by means of a resilient element.

During the swivel movement from the unlocked position to the mounted position, the swivel lever may move the latch out of the housing of the connection module for positive connection to the conductor rail module (e.g., to the step of the conductor rail module). Alternatively or in addition, the swivel lever may press a stamper of the connection module against a support surface of the conductor rail module during the swivel movement from the mounted position to the unlocked position to release the contact between the conductor rails and the respective rail contact.

In the following, embodiments of this disclosure are explained in more detail with reference to the drawings.

DETAILED DESCRIPTION

Figure 1:
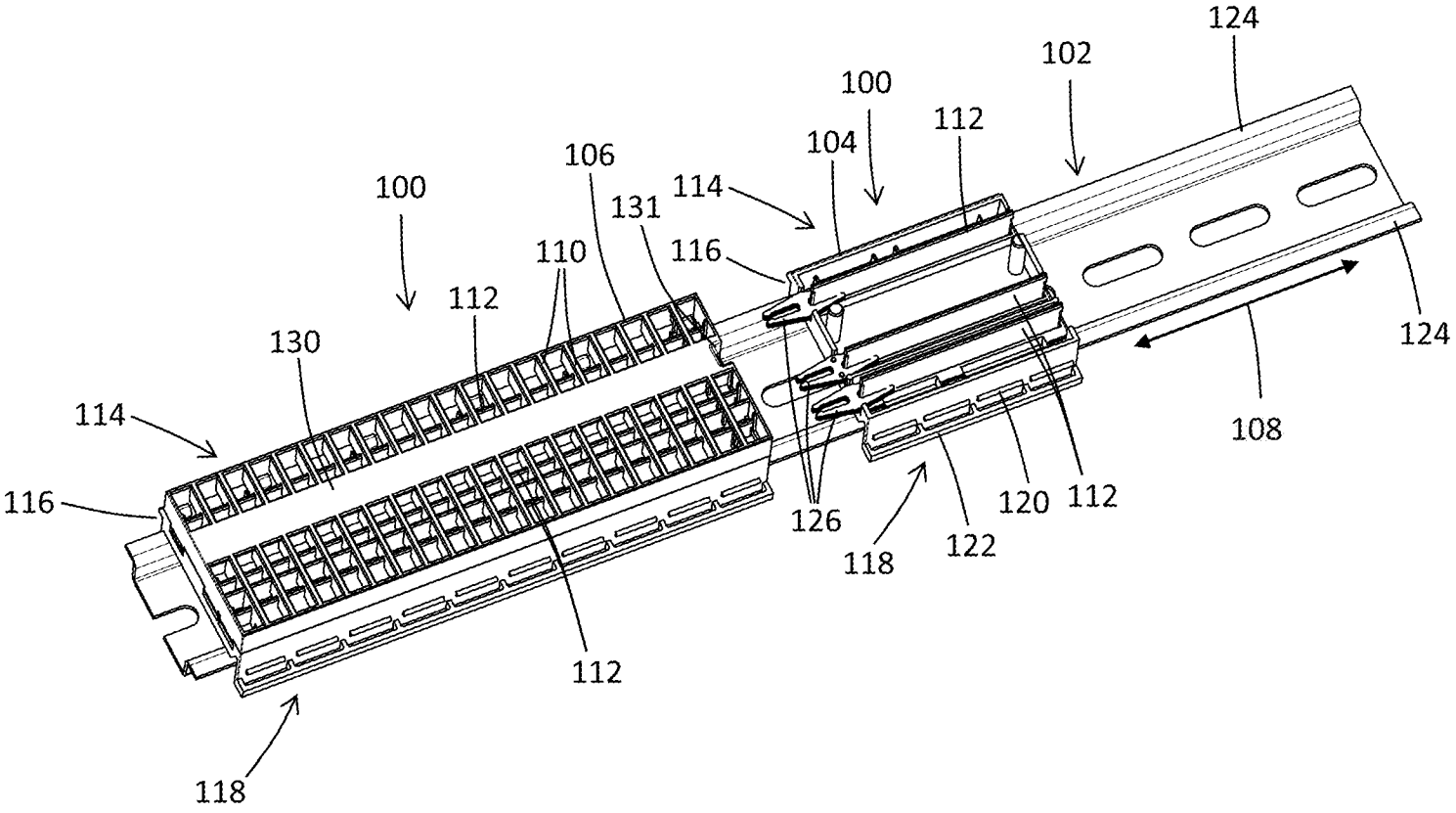
FIG. 1 schematically illustrates a perspective view of a first and second embodiment of a conductor rail module mounted on an exemplary mounting rail, the conductor rail module being open according to the first embodiment.

FIG. 1 schematically shows a perspective view of a first embodiment (left) and a second embodiment (right) of a conductor rail module mounted on an exemplary mounting rail for distributing a direct current to connection modules arranged along the mounting rail or (in the case of FIG. 1) arrangeable. The conductor rail module is generally designated herein with reference numeral 100.

For better illustration, the conductor rail module is opened according to the first embodiment (right). Otherwise, the second embodiment (left) differs from the first embodiment (right) of the conductor rail module in length and thus in the number of slots for the connection modules. The features described herein may be present in both embodiments.

The conductor rail module 100 comprises a housing whose electrically insulating rear section 104 is positively connected or connectable to the mounting rail 102. A front section 106 of the housing has numerous electrically insulating transverse struts 110 extending transversely to a longitudinal direction 108 of the conductor rail module 100. In addition, the conductor rail module 100 comprises at least two conductor rails 112 extending in the housing between the rear section 104 and the front section 106 in the longitudinal direction 108, which are configured to contact the connection modules for distributing the direct current through a gap between the transverse struts 110 when the connection modules are in a position mounted on the conductor rail module 100.

The alignment of the transverse struts 110 is also referred to as the transverse direction.

The rear section 104 of the housing comprises a step 116 on a first long side 114 with a retaining surface facing away from the front section 106. The retention surface is parallel to the longitudinal direction 108 and the transverse direction.

On a second long side 118, opposite the first long side 114 in the transverse direction, the rear section 104 of the housing comprises snap-in profiles 120. The snap-in profiles 120 may comprise projections on the rear section 104 extending in the longitudinal direction 108. In addition, the rear section 104 of the housing has a stop 122 on the second long side 118, which is lower (i.e., in a plane further away from the front section 106) than the snap-in profiles 120.

To mount (or install) a connection module, it may first be brought into contact only with the stop 122 and then be pushed over the step 116 in a tilting movement with the longitudinal direction 108 as axis of rotation on the first long side 114. In doing so, a latch on the connection module may slide over the outwardly inclined approach slope of the step 116 and make positive contact (e.g., a form-fit connection) with the retaining surface behind the step 116, whereby the snap-in profile 120 on the opposite second long side 118 is in positive engagement with a complementary snap-in profile on the connection module.

The conductor rail module 100 comprises mutually facing detents on an underside of the rear section 104. When the conductor rail module 100 is pressed onto the mounting rail 102 (e.g., by pressing on the support surface 130), the detents slide over snap-in edges 124 of the mounting rail 102 facing away from each other in the transverse direction for the form-fit connection of the rear section 104 with the mounting rail 102.

The mounting rail 102 may be a conventional top-hat rail. In particular, the first and second embodiments of the conductor rail module 100 shown in FIG. 1 enable the distribution of a certain type of current and current intensity along a universal, conventional mounting rail 102.

The conductor rail modules 100, which are connected to the mounting rail in a form-fit manner, can be moved in the longitudinal direction on the mounting rail 102. The longitudinal movement may be used to bring the end faces of conductor rail modules 100 adjacent to each other on the mounting rail 102 into contact. A punched contact 126 connects the front ends of corresponding conductor rails 112 of the adjacent conductor rail modules 100.

In order to be able to transmit a current intensity of 40 A continuous current in the smallest installation space, for example, a flat punched contact 126 is manufactured several times, e.g., in triplicate, to form an assembly. In this way, the several contact points of a punched contact 126 (for example, the three individual contact points of each stratification sheet of the punched contact 126) divide the current among themselves, so that total heating may be reduced.

Furthermore, this assembly of the punched contact 126 has only a small structure, so that this electrical connector of the conductor rails 112 may be placed underneath a rail contact (i.e., an electrical tap for contacting the individual conductor rails 112) of the mounted connection modules. For example, in the longitudinal direction, the punched contact 126 overlaps with the outermost transverse struts 110 of the conductor rail module 100, with the outermost of the snap-in profiles 120 of the conductor rail module 100 and/or with a section of one of the conductor rails 112 of the conductor rail module 100 contacted or contactable by a rail contact 208 of the connection module 200.

Optionally, at least one end face of the conductor rail module includes a recess 131. The recess 131 is a recess in the respective end face. In addition, recess 131 is a recess in a support surface 130 of the front section 106 facing away from the rear section 104. Recess 131 may be continuous from the front section to the support surface 130. Recess 131 is configured to shift the conductor rail module 100 against an adjacent conductor rail module 100 along the mounting rail 102 by means of a lever inserted (or received) into recess 131.

Figure 2:
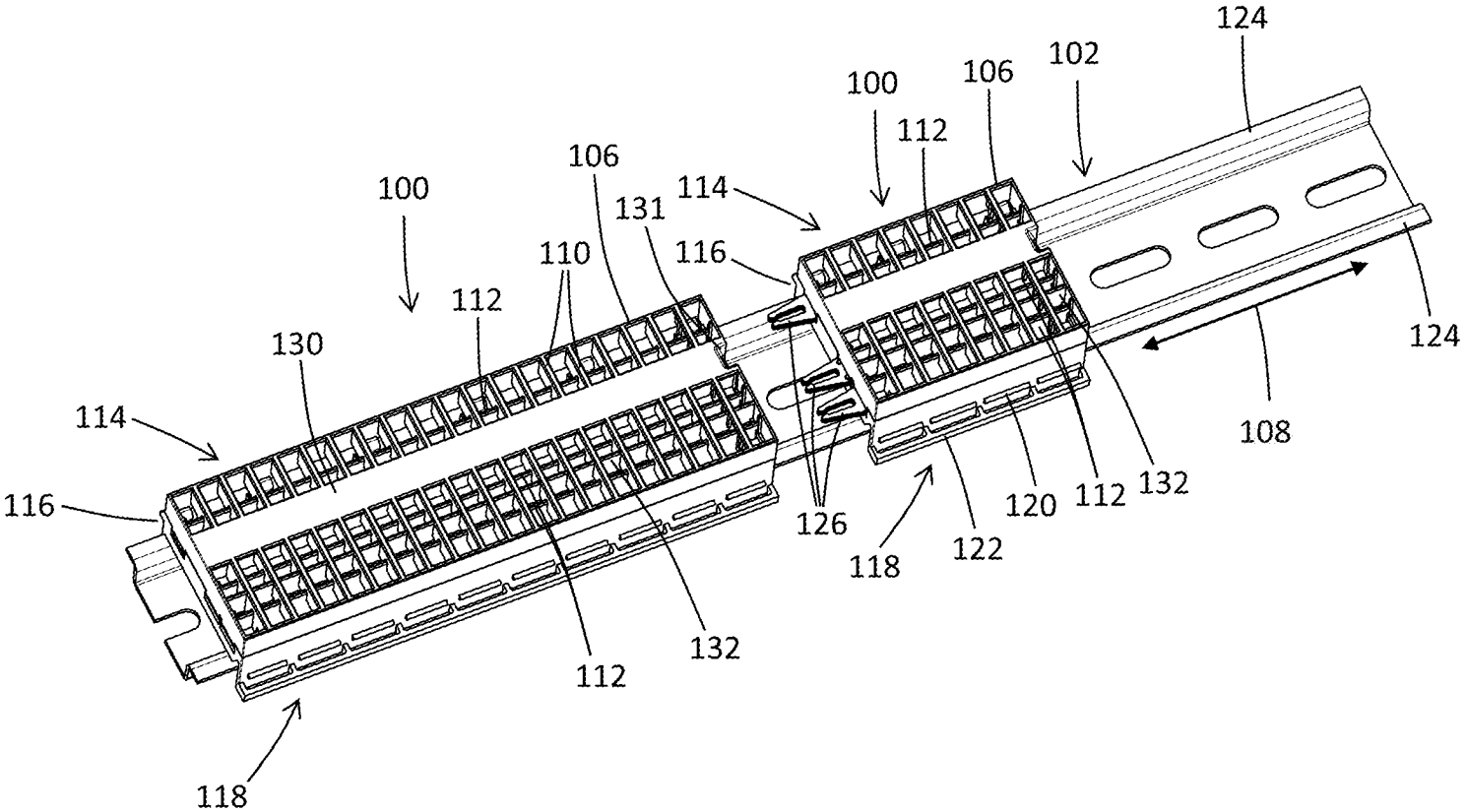
FIG. 2 schematically illustrates a perspective view of a first and second embodiment of the conductor rail module, both conductor rail modules being closed.

FIG. 2 schematically shows a perspective view of the first and second embodiments of the conductor rail module 100. FIG. 2 differs from FIG. 1 in that the first embodiment (right) of conductor rail module 100 is closed by means of the front section 106.

As described with reference to FIGS. 1 and 2, embodiments of the conductor rail module 100 may form a distribution system, e.g., for distributing a direct current at 24 V. In the distribution system, the corresponding conductor rails 112 of adjacent conductor rail modules 100 are electrically connected by means of punched contacts 126.

Figure 3B:
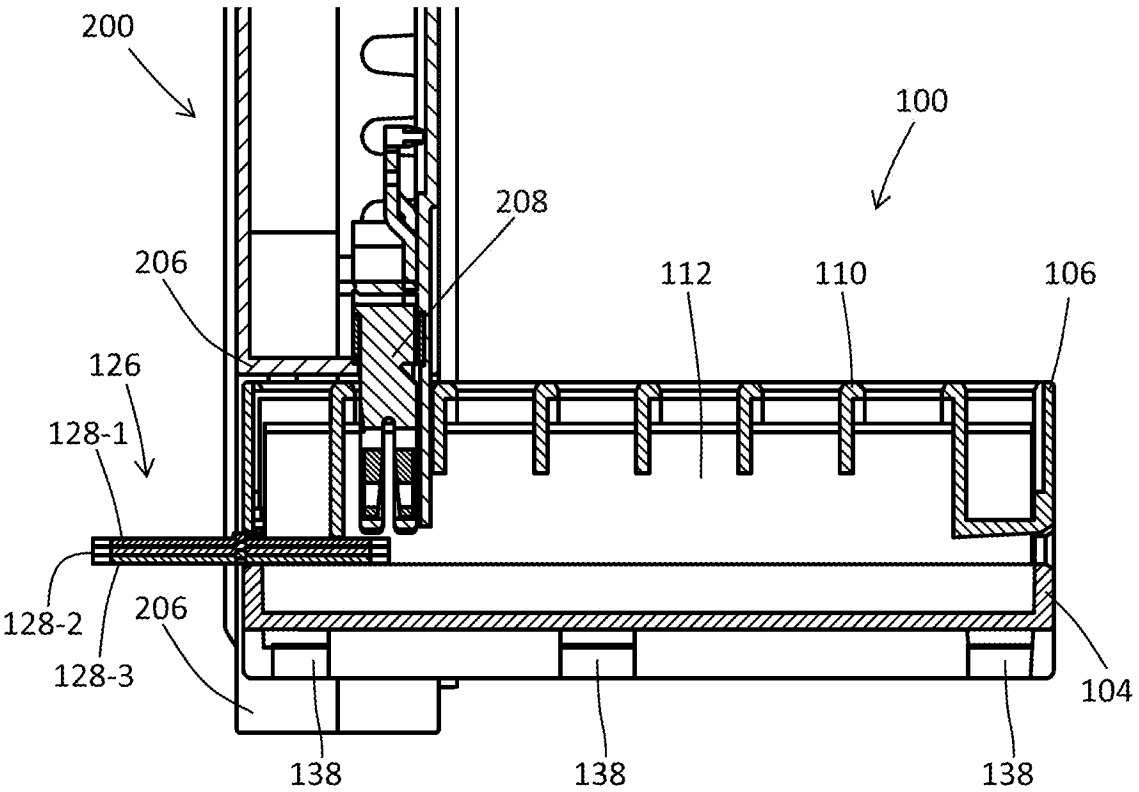
FIG. 3B illustrates a schematic sectional view of the first design example of the conductor rail module and of the first design example of the connection module mounted thereon.
Figure 3A:
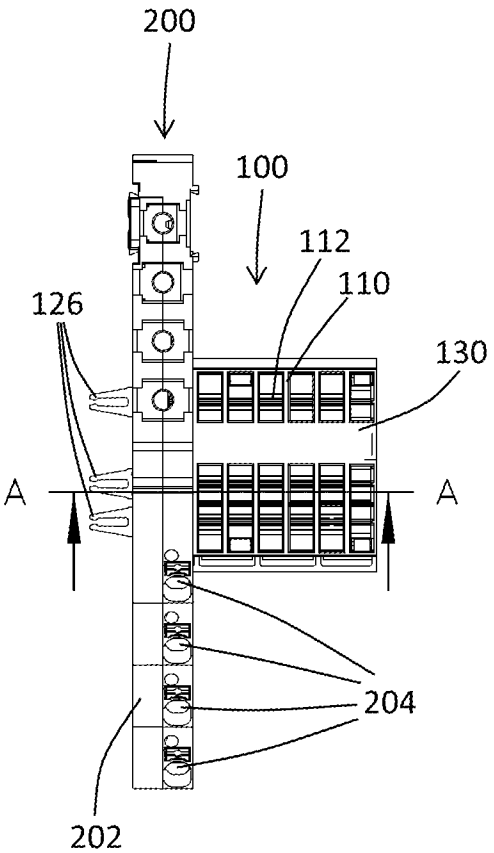
FIG. 3A illustrates a schematic plan view of a conductor rail module according to the first embodiment of this disclosure and a connection module mounted on the conductor rail module according to a first embodiment of this disclosure.

FIG. 3A shows a schematic plan view of a conductor rail module 100 according to the first embodiment of this disclosure and a connection module mounted on the conductor rail module 100 according to a first embodiment of this disclosure. The connection module for branching a direct current distributed along a mounting rail is generally referred to herein as reference numeral 200.

FIG. 3B shows a schematic sectional view of the first embodiment of the conductor rail module 100 and the first embodiment of the connection module 200 mounted thereon along the section line A-A drawn in FIG. 3A.

The connection module 200 comprises a housing whose rear 206 is mounted or mountable to a conductor rail module 100 (for example, according to the above aspect). A front 202 of the housing has at least two terminal contacts 204 for connecting a load or a source of direct current. The connection module 200 also has at least two rail contacts 208 protruding from the rear 206 for tapping the direct current. The rail contacts 208 are configured to contact a conductor rail 112 of the conductor rail module 100 when the connection module 200 is in a position mounted on the conductor rail module 100.

In each embodiment, the connection module 200 may include a circuit breaker, for example an electronic fuse for DC voltage, e.g., 24 V. The sectional view in FIG. 3B shows an example of an electrical connection below the device circuit breaker.

FIG. 3B also shows a sectional view of an embodiment of the punched contact 126. The punched contact 126 comprises several (e.g., three) stratification sheets 128-1 to 128-3. The stratification sheets 128-1 to 128-3 are, for example, positively secured by several beads against relative movement in the longitudinal direction 108 or the transverse direction.

Furthermore, the sectional view of FIG. 3B shows embodiments of the detents 138 formed on the rear section 104 on the first long side 114 for positive connection of the rear section 104 with the mounting rail 102 (not shown in FIGS. 3A and 3B for clarity).

In each embodiment of the connection module 200, as shown in FIG. 3B, the rail contact 208 may include a double-sided tulip contact. In order to achieve a sufficiently large contact area for the current to be tapped, each rail contact 208 may comprise a double-sided double contact, i.e., the conductor rail 112 is contacted twice on each side.

Figure 4:
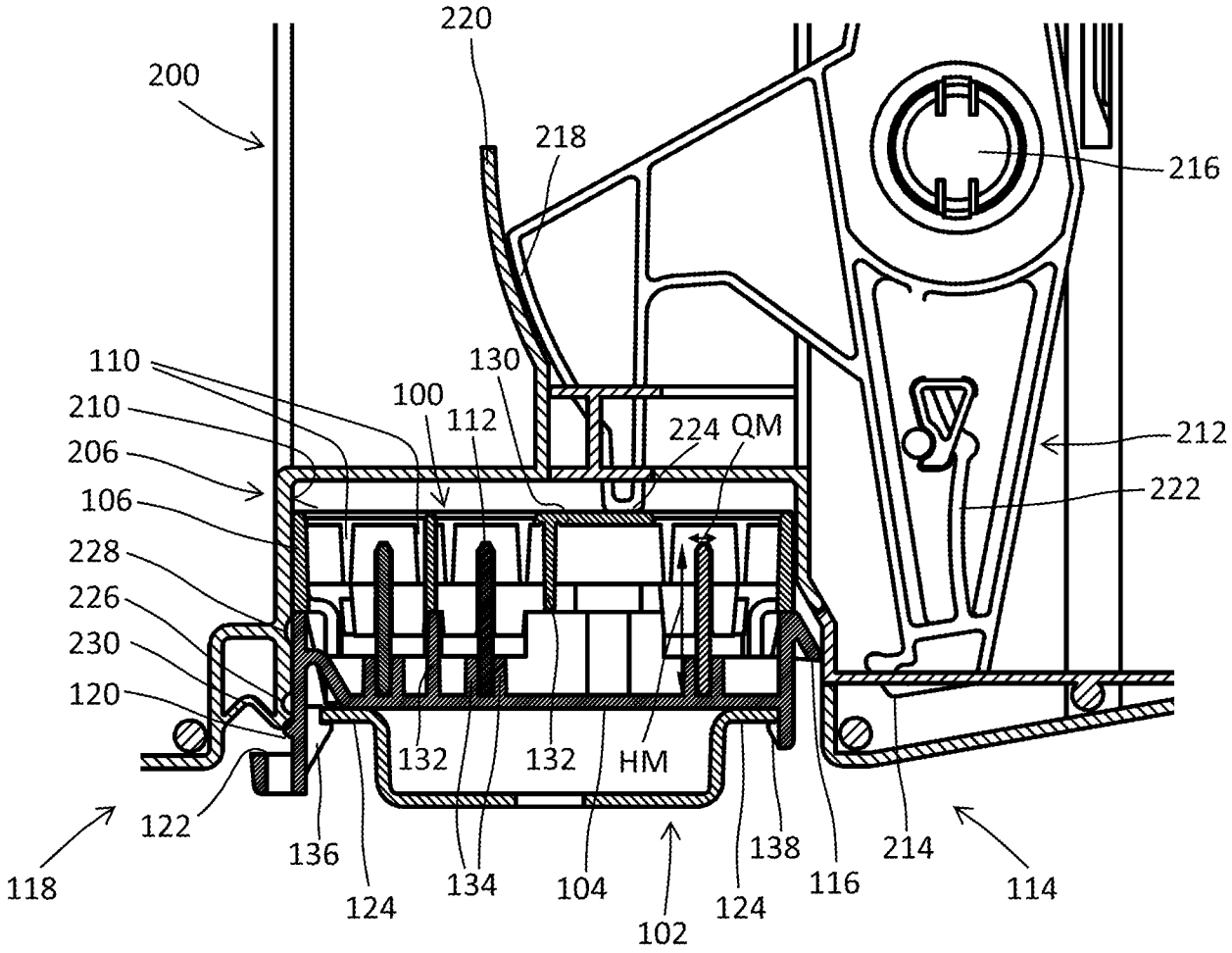
FIG. 4 illustrates a schematic sectional view of a conductor rail module according to a third embodiment of this disclosure and of a connection module according to a second embodiment of this disclosure.

FIG. 4 shows a schematic sectional view of a conductor rail module 100 according to a third embodiment of this disclosure and a connection module 200 according to a second embodiment of this disclosure. Features which are identical or interchangeable with features of one of the above-mentioned embodiments are marked with the same reference numeral. The third embodiment of the conductor rail module 100 may differ from the first and second embodiments of the conductor rail module 100 only in its length in the longitudinal direction 108, i.e., in the number of transverse struts 110 and the corresponding slots for the connection modules 200.

The connection module 100 may include a partition wall 132 between adjacent conductor rails 112 of the connection module 100, which extends in the longitudinal direction 108.

Each conductor rail 112 may comprise a transverse dimension QM in the transverse direction and a height dimension HM perpendicular to the longitudinal direction 108 and the transverse direction. The height dimension HM is several times larger than the transverse dimension QM, for example HM>5·QM. This means that the conductor rails are arranged flat and may be perpendicular to the plane of the mounting rail 102.

Each conductor rail 112 in the rear section 104 may be enclosed in a groove 134 extending in the longitudinal direction 108. The groove 134 may enclose a fraction of the height dimension HM of the conductor rail 112, for example less than a quarter of the height dimension.

FIG. 4 shows embodiments of the opposite detents 136 and 138 for positive connection of the rear section 104 with the snap-in edges 124 of the mounting rail 102.

The second embodiment of the connection module 200 shown in FIG. 4 has a recess 210 on the rear 206 to accommodate the conductor rail module 100 in the mounted position.

FIG. 4 shows the connection module 200 and the conductor rail module 100 in an unmounted position. The connection module 200 is in an unlocked position relative to the conductor rail module 100.

As shown in FIG. 4, each embodiment of the connection module 200 may include a swivel lever 212 that can be swiveled in the housing of the connection module 200. The swivel lever 212 can be swiveled between the mounted position and the unlocked position (shown as an example in FIG. 4). The swivel lever 212 comprises a latch 214 which, in the mounted position, interacts with the step 116, e.g., resting against the retaining surface of the step 116, for the positive connection of the connection module 200 to the conductor rail module 100. In the unlocked position (shown as an example in FIG. 4), the latch 214 releases the step 116.

The swivel lever 212 may be pivotally mounted (e.g., swivel-mounted) on a sliding bearing 216. Alternatively, or in addition, the swivel lever 212 may be pivotally mounted (e.g., swivel-mounted) with a sliding surface 218 of the swivel lever 212 on a stationary sliding surface 220 in the housing of the connection module 200.

The swivel lever 212 may comprise a resilient element 222 which exerts a preload (e.g., a bias or pretension) on the swivel lever 212 which is able to swivel the swivel lever 212 from its unlocked position to the mounted position. When the connection module 200 is mounted, this preload may cause a running slope or contact slope of the latch 214 to slide over the starting slope of the step 116, the latch 214 to engage at the step 216 and be secured in the mounted position.

Optionally, the swivel lever 212 includes a stamper 214 which is arranged to exert a pressure on the support surface 130 of the conductor rail module 100 during the swivel movement of the swivel lever 212 from the mounted position to the unlocked position, which presses the conductor rail module 100 out of the recess 210 of the connection module 200.

The snap-in profile 226 of the connection module 200, which is complementary to the snap-in profile 120 of the conductor rail module 100, is located on the second long side 118 opposite the latch 214 in the transverse direction. For example, the snap-in profile 120 of the conductor rail module 100 has a projection and the complementary snap-in profile 226 of the connection module 200 has a recess of complementary shape to the projection, or vice versa.

Optionally, the rear 206 includes a resilient support 228 of the complementary snap-in profile 226. The resilient support 228 may be realized by weakening (e.g., local reduction of a wall thickness) a wall on which the complementary snap-in profile 226 is located. Alternatively, or as a complementary snap-in profile 226 is supported by a resilient element 230 on the rear 206.

Figure 5B:
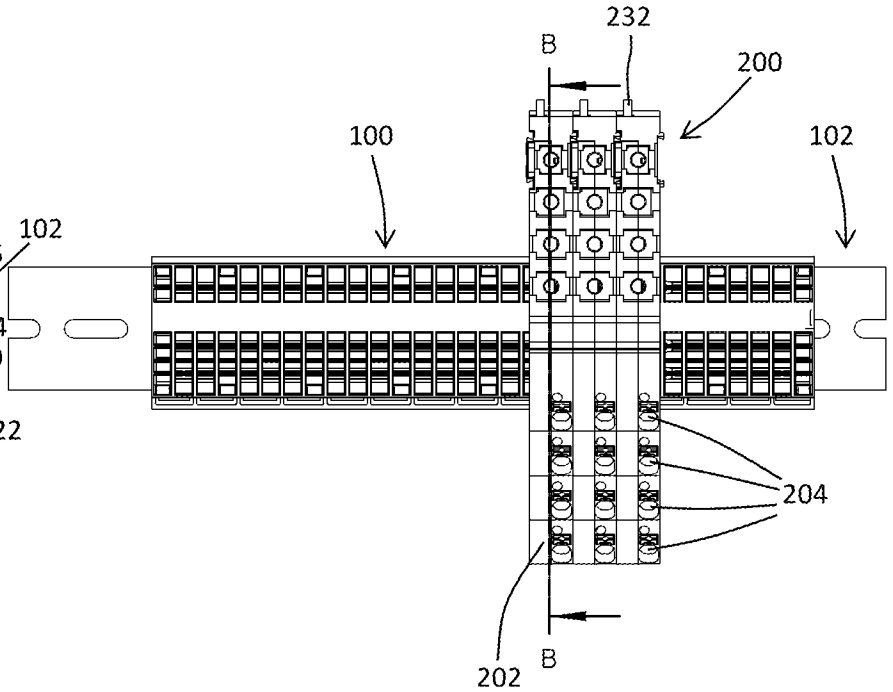
FIG. 5B illustrates a schematic plan view of the third embodiment of the conductor rail module and several connection modules mounted thereon according to the second embodiment.
Figure 5A:
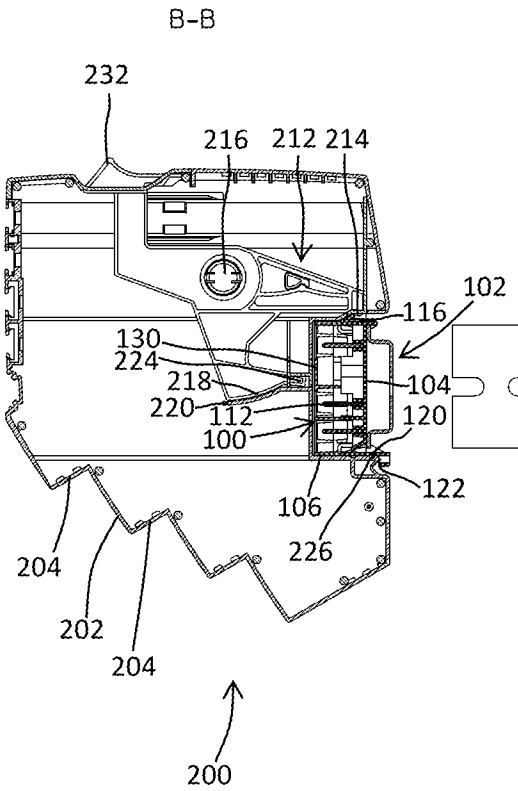
FIG. 5A illustrates a schematic sectional view of the third embodiment of the conductor rail module and the second embodiment of the connection module mounted thereon.

FIG. 5A shows a schematic sectional view of the third embodiment of the conductor rail module 100 and the second embodiment of the connection module 200 mounted thereon FIG. 5B shows a schematic plan view of the third embodiment of the conductor rail module 100 and several connection modules 100 mounted thereon according to the second embodiment. FIG. 5A shows the sectional view along the cutting line B-B in FIG. 5B.

In the mounted position shown in FIGS. 5A and 5B, the snap-in profiles 120 and 226 on the second long side 118 and the step 116 and the latch 214 on the first long side 114 are engaged.

The swivel lever 212 includes an operating surface 232, which is accessible at or next to the front 202 through an opening in the housing of the connection module 200. By pressing the operating surface 232, the swivel lever 212 may be moved into the unlocked position against the pretension of the resilient element 222.

Figure 6B:
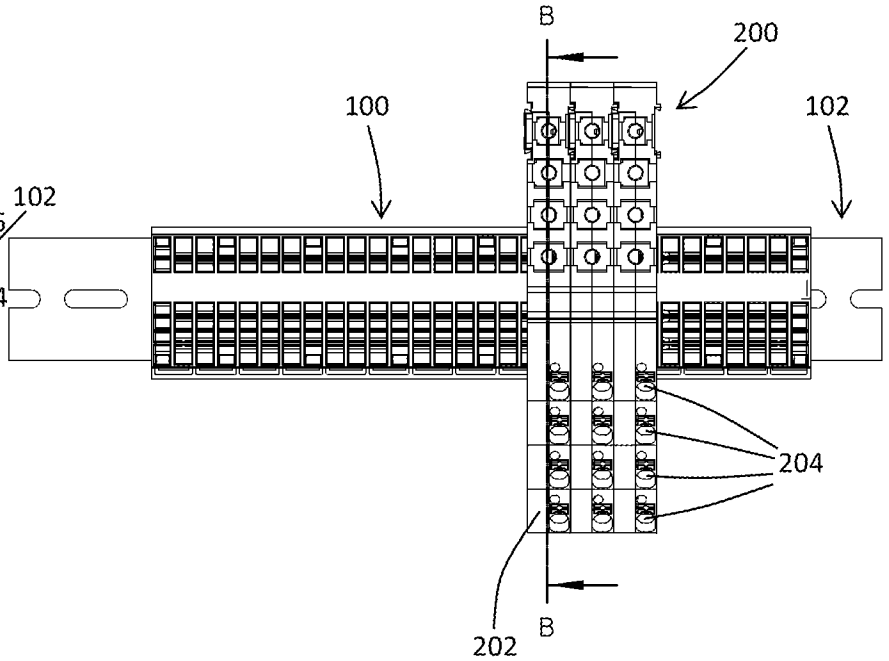
FIG. 6B illustrates a schematic plan view of the third embodiment of the conductor rail module and several connection modules according to the second embodiment in an unlocked position.
Figure 6A:
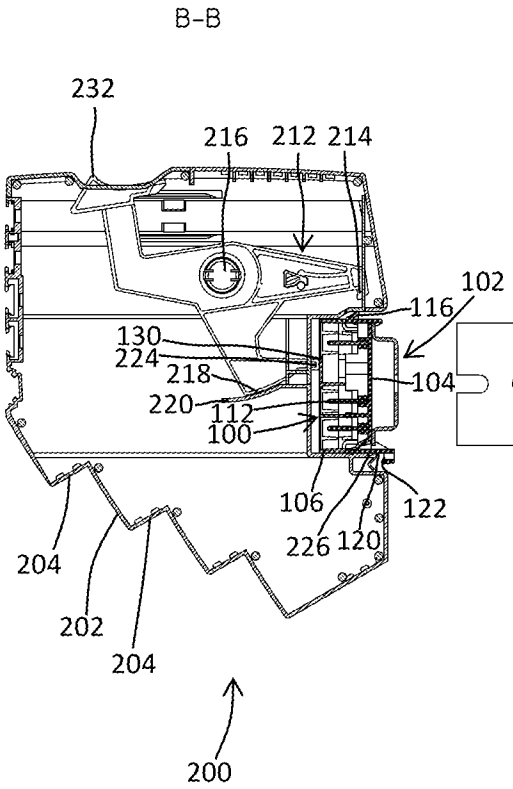
FIG. 6A illustrates a schematic sectional view of the third embodiment of the conductor rail module and the second embodiment of the connection module in an unlocked position.

FIG. 6A shows a schematic sectional view of the third embodiment of the conductor rail module 100 and the second embodiment of the connection module 200 in the unlocked position. FIG. 6B shows a schematic plan view of the third embodiment of the conductor rail module 100 and several connection modules 200 according to the second embodiment in the unlocked position. FIG. 6A shows the sectional view along the cutting line B-B in FIG. 6B.

In the unlocked position shown in FIGS. 6A and 6B, the connection module 200 in recess 210 is moved away from the conductor rail module 200 compared to the mounted position shown in FIGS. 5A and 5B. The snap-in profiles 120 and 226 on the second long side 118 as well as the step 116 and the latch 214 on the first long side 114 are each disengaged.

Each embodiment of the 200 connection module may include a circuit breaker, e.g., for 24 V DC and/or a current limit value of 20 A to 40 A. In a distribution system with one or more conductor rail modules 100, the direct current may be distributed to several connection modules 200, e.g., without the need for wiring when branching the direct current from conductor rails 112.

Figure 7B:
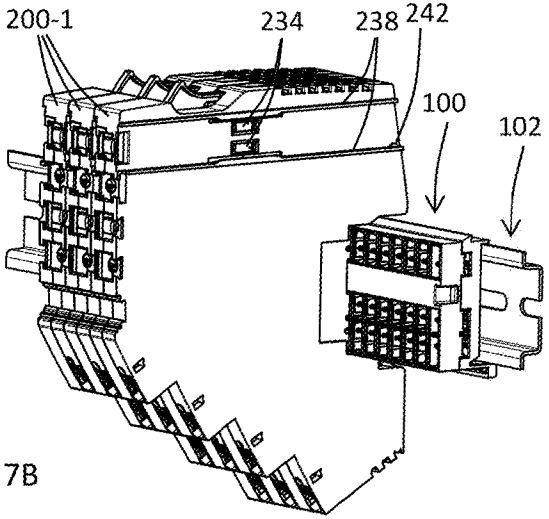
FIG. 7B schematically illustrates a second perspective representation of the third embodiment of the conductor rail module and the several third embodiments mounted thereon of the connection module for the data bus.
Figure 7A:
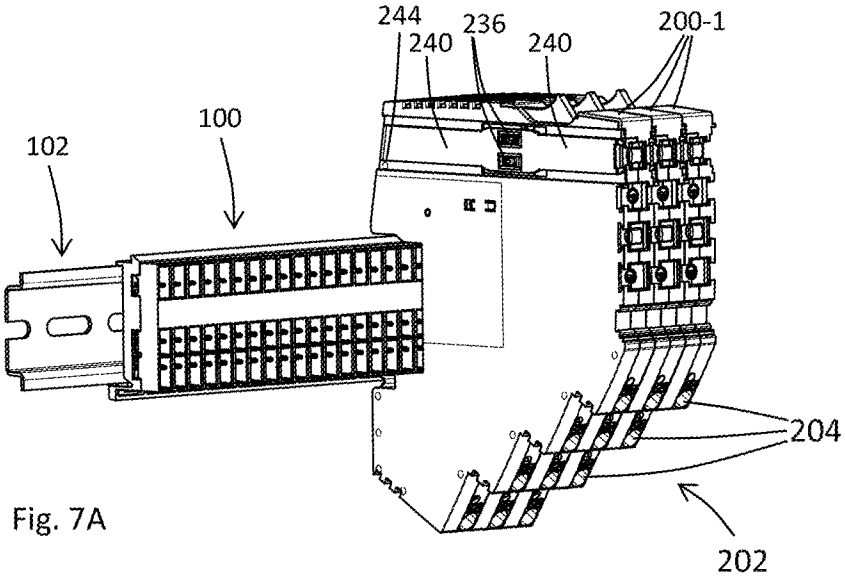
FIG. 7A illustrates a schematic first perspective view of the third embodiment of the conductor rail module and several connection modules mounted thereon according to a third embodiment of this disclosure for a data bus.

FIG. 7A schematically shows a first perspective view of the third embodiment of the conductor rail module 100 and several connection modules 200 mounted thereon according to a third embodiment of this disclosure. FIG. 7B schematically shows a second perspective view of the third embodiment of the conductor rail module 100 and the several third embodiments of the connection module 200 mounted thereon for the data bus. In this example, the reference numeral 200 generally designates the connection module and includes certain embodiments 200-1 and 200-2 of the connection module 200.

The third embodiment of the connection module 200 includes a data bus, for example a serial data bus. The third embodiment may also include any feature described in the context of the first or second embodiment.

Since power is supplied to the connection modules 200 via the conductor rails 112 of the conductor rail modules 100, e.g., only contacts 234 and complementary contacts 236 are required for data signals of the data bus. This means that contacts 234 and 236 of the data bus may only transmit data signals, while the conductor rail modules 100 provide an associated power supply. In the case of passive (i.e., not using the data bus) connection modules 200-1, the data bus contacts 234 and 236 may be passed through in the housing of the respective connection module 200.

Contacts 234 and 236 are arranged resiliently on 108 opposite sides of the connection modules 200 in the longitudinal direction. When a second connection module 200 is moved into the mounted position next to an already mounted first connection module 200 with its dovetail protrusion 240 between the two dovetail grooves 242, the corresponding contacts 234 and contacts 236 are electrically connected. By mounting several connection modules 200 (e.g., passive or using the data bus) with data bus contacts 234 and 236 adjacent to each other on the conductor rail module 100, the data bus may be modularly structured parallel to distributing the direct current along the mounting rail over a length depending on requirements.

Figure 8B:
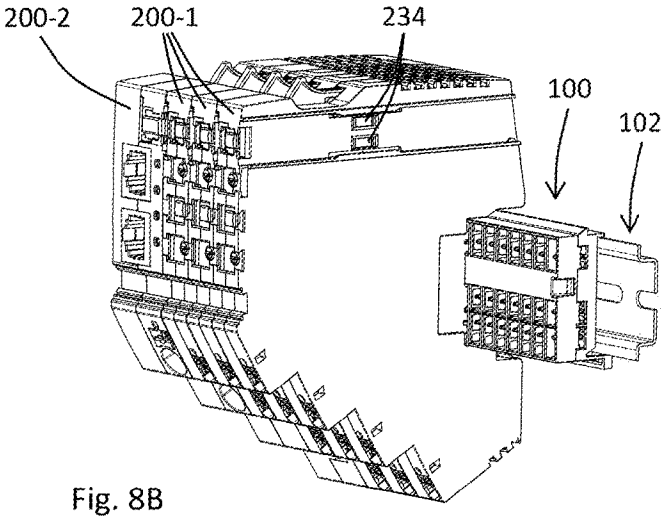
FIG. 8B schematically illustrates a second perspective view of the third embodiment of the conductor rail module, the several third embodiments of the connection module mounted on it and the fourth embodiment of the connection module mounted on it for termination of the data bus.
Figure 8A:
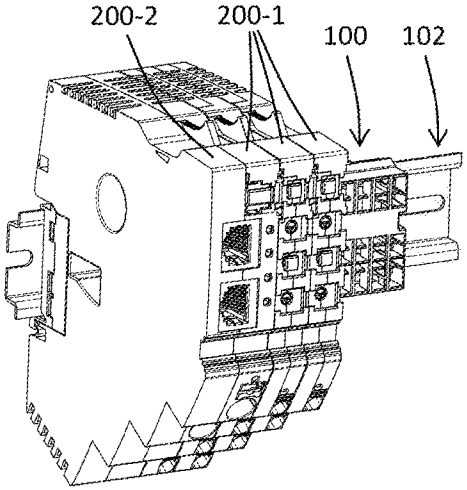
FIG. 8A schematically illustrates a first perspective representation of the third embodiment of the conductor rail module and the plurality of connection modules mounted thereon in accordance with the third and a fourth embodiments of this disclosure for termination of the data bus.

FIG. 8A schematically shows a first perspective view of the third embodiment of the conductor rail module 100 and several connection modules 200 mounted on it according to the third embodiment 200-1 and a fourth embodiment 200-2. The fourth embodiment 200-2 of the connection module 200 is configured to terminate the data bus. FIG. 8B schematically shows a second perspective view of the third embodiment of the conductor rail module 100, the several third embodiments 200-1 of the connection module 200 mounted thereon, and the fourth embodiment 200-2 of the connection module 200 mounted thereon for terminating the data bus.

The data bus may be forwarded via a number of embodiments 200-1 of the connection module. An embodiment 200-2 of connection module 200 may terminate the data bus routed along mounting rail 102. For example, the connection module 200-2 may send and/or receive data via the data bus. Optionally, the connection module 200-2 may include a data processing unit configured to convert the data of the serial data bus into frames (also called "frames") according to an Ethernet protocol and to receive and/or output corresponding data signals at at least one socket (e.g., RJ-45 sockets) in the housing of the connection module 200-2.

LIST OF REFERENCE NUMERALS

Conductor rail module 100
Mounting rail, e.g., a top-hat rail 102
Rear section of the housing of the conductor rail module 104
Front section of the housing of the conductor rail module 106
Longitudinal direction 108
Transverse strut, e.g., cross strut) 110
Conductor rail 112
First long side 114
Step 116
Second long side 118
Snap-in profile of the conductor rail module 120
Stop 122
Snap-in edge of top-hat rail 124
Punched contact 126
Stratification sheets of the punched contact 128-1, 128-2, 128-3
Support surface 130
Continuous recess in support surface and front face 131
Partition wall 132
Groove 134
First detent 136
Second detent 138
Connection module 200
Front of the housing of the connection module 202
Terminal contact 204
Rear of the housing of the connection module 206
Rail contact, e.g., double-sided tulip contact 208
Recess 210
Swivel lever 212
Latch of the swivel lever 214
Swivel bearing of the swivel lever, e.g., radial sliding bearing 216
Sliding surface of the swivel lever 218
Stationary sliding surface 220
Resilient element of the swivel lever 222
Stamper of the swivel lever 224
Complementary snap-in profile of the connection module 226
Resilient support of the complementary snap-in profile 228
Resilient element of the complementary snap-in profile 230
Operating surface of the swivel lever 232
Data bus contacts, e.g., for serial data bus 234
Complementary data bus contacts 236
Dovetail groove or fastening groove 238
Dovetail protrusion 240

Snap-in projection 242
Snap-in recess 244

What is claimed is:

1. A conductor rail module for distributing a direct current to connection modules arranged or arrangeable along a mounting rail, comprising:

a housing, an electrically insulating rear section of which is connected or connectable with the mounting rail in a form-fit manner, and a front section of which has a plurality of electrically insulating transverse struts extending transversely to a longitudinal direction of the conductor rail module; and at least two conductor rails extending in the housing between the rear section and the front section in the longitudinal direction, the at least two conductor rails configured to contact the connection modules for distributing the direct current through a gap between the transverse struts when the connection modules are in a position mounted on the conductor rail module.

2. The conductor rail module according to claim 1, wherein the housing has steps on a first long side for mounting the connection modules, or wherein the housing, has snap-in profiles on a second long side for mounting the connection modules.

3. The conductor rail module according to claim 1, wherein the housing has an electrically insulating partition wall between two adjacent conductor rails of the at least two conductor rails.

4. The conductor rail module according to claim 1, wherein the mounting rail comprises snap-in edges projecting transversely to the longitudinal direction, and wherein the rear section has at least two opposite, mutually facing detents, which are configured to slide from an unmounted position of the conductor rail module over the snap-in edges into a snap-in position in which the detents connect the rear section of the conductor rail module to a top-hat rail in a form-fitting manner.

5. The conductor rail module according to claim 1, wherein the at least two conductor rails comprise a conductor rail for functional earthing, a conductor rail to a neutral conductor, and a conductor rail to a positive pole.

6. The conductor rail module according to claim 1, wherein each of the at least two conductor rails has a transverse dimension (QM) transverse to the longitudinal direction and a height dimension (HM) in the direction between the front section and the rear section, the height dimension (HM) being greater than the transverse dimension (QM).

7. The conductor rail module according to claim 1, wherein at least one end face of the conductor rail module is configured to electrically connect the at least two conductor rails of the conductor rail module to corresponding conductor rails of a conductor rail module adjacent to the respective end face in each case.

8. The conductor rail module according to claim 1, further comprising, on at least one end face of the conductor rail module, a punched contact which is plugged or pluggable onto an associated conductor rail in the longitudinal direction and is configured to electrically connect the at least two conductor rails of the conductor rail module to corresponding conductor rails of a conductor rail module adjacent to the respective end face in each case.

9. The conductor rail module according to claim 8, wherein the punched contact has at opposite ends in the longitudinal direction in each case an open clamping slot, the open width of which is equal to or smaller than the transverse dimension (QM) of the respectively assigned conductor rail.

10. The conductor rail module according to claim 8, wherein the punched contact comprises two, three, or more stratification sheets of the same shape and stacked on top of each other.

11. The conductor rail module according to claim 8, wherein the punched contact overlaps in the longitudinal direction:

(a) at least one of the transverse struts of the conductor rail module;

(b) at least one of snap-in profiles of the conductor rail module; or (c) at least one section of one of the at least two conductor rails of the conductor rail module, which section is contacted or contactable by a rail contact of a connection module.

12. The conductor rail module according to claim 1, on at least one end face with respect to the longitudinal direction of the conductor rail module further comprising a continuous recess both in the respective end face and in a support surface of the front section facing away from the rear section, wherein the continuous recess is configured to displace the conductor rail module against an adjacent conductor rail module along the mounting rail by a lever received or receivable in the continuous recess.

13. A connection module for branching a direct current distributed along a mounting rail, comprising:

a housing, the rear of which is mounted or mountable on a conductor rail module according to claim 1, and the front of which has at least two terminal contacts for connecting a load or source of the direct current; and at least two rail contacts projecting at the rear, which are configured to each contact a conductor rail of the conductor rail module when the connection module is in a position mounted on the conductor rail module for branching the direct current.

14. The connection module according to claim 13, wherein at least one or each of the at least two rail contacts comprises a double-sided spring contact configured to resiliently contact the respective conductor rail on both sides.

15. The connection module according to claim 13, wherein the rear of the connection module comprises a recess for receiving the conductor rail module in the mounted position.

16. The connection module according to claim 13, wherein the connection module comprises an overcurrent protection device between the at least two rail contacts and the terminal contacts to protect the load or source of the direct current.

17. The connection module according to claim 13, wherein the rear is mounted or mountable on a first and a second conductor rail module adjacent to each other in the longitudinal direction at their respective end faces, and wherein at least a first of the at least two rail contacts of the connection module contacts the first conductor rail module and at least a second of the at least two rail contacts of the connection module contacts a second conductor rail module of the adjacent conductor rail modules when the connection module is in the mounted position.

18. The connection module according to claim 13, further comprising:

a latch movable on a first long side transverse to the longitudinal direction for a form-fit connection of the connection module to the conductor rail module in the mounted position; or a snap-in profile on a second long side of the rear for a form-fit connection of the connection module to the conductor rail module in the mounted position.

19. The connection module according to claim 18, further comprising:

a swivel lever pivotally mounted in the housing, which can be swiveled into an unlocked position by an operating surface projecting from the housing in the mounted position and can be swiveled from the unlocked position into the mounted position by a resilient element, wherein the swivel lever during swivel movement from the unlocked position to the mounted position moves the latch out of the housing of the connection module for the form-fit connection to the conductor rail module, or wherein the swivel lever presses a stamper of the connection module against a support surface of the conductor rail module during the swivel movement from the mounted position into the unlocked position to release the contact between the at least two conductor rails and the respective rail contact.

20. The conductor rail module according to claim 1, wherein the rear section has steps on a first long side for mounting the connection modules, or wherein the rear section has snap-in profiles on a second long side for mounting the connection modules.

* * * * *